US005148690A

United States Patent [19]

Wang

[11] Patent Number: 5,148,690

[45] Date of Patent: Sep. 22, 1992

[54] TWO-SECTION TYPE PICKPROOF LOCK ASSEMBLY

[76] Inventor: Ruei-Fang Wang, No. 9-1, An-Ho St., Hsiao-Kang Dist., Kaohsiung City, Taiwan

[21] Appl. No.: 716,780

[22] Filed: Jun. 18, 1991

[51] Int. Cl.[5] ..... E05B 67/24

[52] U.S. Cl. ..... 70/38 A; 70/DIG. 37; 70/358; 70/419; 70/403; 70/375

[58] Field of Search ..... 70/419, 38 A, 375, 358, 70/373, 404, 403, DIG. 37

[56] References Cited

U.S. PATENT DOCUMENTS

| | | | |
|---|---|---|---|
| 4,006,614 | 2/1977 | Decker | 70/419 |
| 4,098,100 | 7/1978 | Wah | 70/379 R |
| 4,193,277 | 3/1980 | Lo | 70/358 |
| 4,838,051 | 6/1989 | Yang | 70/38 A |

*Primary Examiner*—Renee S. Luebke
*Assistant Examiner*—D. Boucher
*Attorney, Agent, or Firm*—Harness, Dickey & Pierce

[57] ABSTRACT

A pickproof lock assembly has two lock sections which can be opened by a single key. The first lock section includes a key plug and a first set of tumbler members which engage radial pits provided on the key so as to disengage the key plug from the lock shell. The second lock section includes first and second movable plug halves disposed inside the lock shell and a second set of tumbler members. The key has axially extending curve protrusions on one end to move the first and second plug halves and align groove-free spaces on the surface of the first and second plug halves to form a continuous annular path. The second set of tumbler members contacts the first and second plug halves at the annular path to permit rotation of the key plug relative to the lock shell. When non-alignment of the groove-free space of the first and second plug halves occurs due to insertion of a wrong key, rotation of the key plug by the wrong key causes the second set of tumbler members to engage notches on the surface of the first and second plug halves and prevent further rotation of the key plug.

2 Claims, 6 Drawing Sheets

TWO-SECTION TYPE PICKPROOF LOCK ASSEMBLY

BACKGROUND OF THE INVENTION

1. Field of the Invention

This invention relates to a lock assembly, more particularly to a pickproof lock assembly having two lock sections.

2. Description of the Related Art

As crime becomes more and more rampant, it is insufficient to rely solely on the police for security and protection of property. It is also necessary to protect one's self and property through the use of various security devices. One such device is the lock. Locks have been in use for several centuries and have continuously evolved so as to provide people with personal security and protection of property. Even now, many people still spend a considerable amount of time and money so as to improve the design and construction of locks.

There are many types of locks available, the most popular being the key operated lock. The common defect of most key operated locks lies in the construction of the key plug. The key plug is usually provided with a key way which serves as an entrance to the inner machinery of the lock. Thus, even though there are variations in the construction of conventional key operated locks, as long as there is a path to access the machinery of the lock, the lock may be picked and unlocked by someone who is ingenious and familiar with lock constructions. Another main disadvantage of conventional key operated locks is that a thief is given an unlimited number of chances to try and pick the lock.

SUMMARY OF THE INVENTION

The main objective of the present invention is to provide a pickproof lock assembly having two lock sections which can be opened by a single key, which said pickproof lock assembly giving a thief only a single opportunity to try and pick the same.

Accordingly, the preferred embodiment of a two-section pickproof lock assembly of the present invention comprises: a lock shell having a front end, a rear end, a longitudinal opening accessible from the front end, and an inner surface provided with a set of first tumbler holes disposed adjacent to the front end and a set of second tumbler holes disposed adjacent to the rear end; a driving shaft axially disposed in the longitudinal opening and having a transverse head portion, a tail portion journaled on the rear end of the lock shell, and a shaft portion which is rectangular in cross-section; first and second plug halves received in the longitudinal opening and cooperatively forming a cylindrical member in sliding contact with the inner surface of the lock shell, each of the first and second plug halves having a clamping face provided with an axial first notch, the first notch of the first and second plug halves cooperatively confining a rectangular receiving space, the shaft portion of the driving shaft extending into the rectangular receiving space and being clamped by the first and second plug halves, each of the first and second plug halves having a curved surface formed with at least one axially extending second notch which opens from a first end of the first and second plug halves and having a terminating end spaced from a second opposite end of the first and second plug halves to provide a groove-free space between the second end of the first and second plug halves and the terminating end of the second notch; a biasing means to bias each of the first and second plug halves toward the transverse head portion of the driving shaft; a key plug rotatably mounted to the lock shell inside the longitudinal opening adjacent to the front end, the key plug being formed as an annular wall confining an axial key way and having a set of third tumbler holes aligned with the first tumbler holes when the lock assembly is in a locked position, and a rear end provided with first and second axially extending arc projections to engage the transverse head portion of the driving shaft; a first set of tumbler means resiliently extending through the first and third tumbler holes into the key way to engage the lock shell and the key plug when the lock assembly is in the locked position; a second set of tumbler means resiliently extending through the second tumbler holes into the longitudinal opening; and a key having a cylindrical key body provided with radial pits, and a front end formed with first and second axially extending curve protrusions which define a receiving groove therebetween, the first and second curve protrusions having different lengths. The key is inserted in the key way in such a manner that the first set of tumbler means engages the radial pits so as to engage the key body with the key plug and disengage the lock shell from the key plug, thereby permitting rotation of the key plug relative to the lock shell. The curve protrusions move the first and second plug halves away from the transverse head portion against the biasing means to align the groove-free space of the first and second plug halves and form a continuous annular path. The second set of tumbler means contacts the first and second plug halves at the annular path to permit rotation of the key relative to the lock shell. When non-alignment of the groove-free space of the first and second plug halves occur due to insertion of a wrong key into the key way, rotation of the key plug by the wrong key relative to the lock shell causes the second set of tumbler means to engage the second notch of the first and second plug halves, and thus prevents further rotation of the wrong key and the key plug relative to the lock shell.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
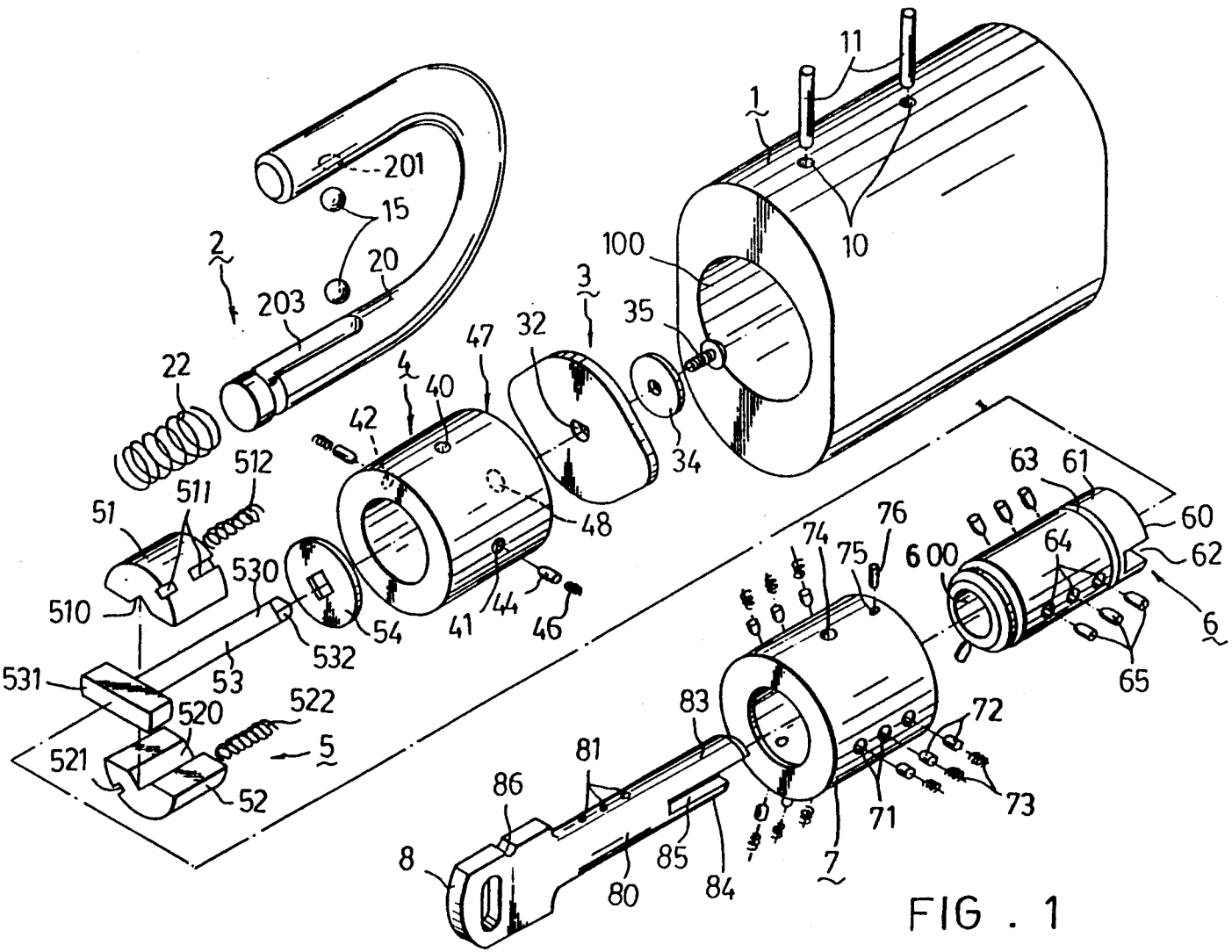
FIG. 1 is an exploded view of the preferred embodiment of a two-section pickproof lock assembly according to the present invention.

Referring to FIG. 1, the preferred embodiment of a two-section type pickproof lock assembly according to the present invention is shown to comprise a lock shell including an outer shell 1,:a first inner shell 4 and a second inner shell 7, a shackle means 2, a control plate 3, a resisting means 5, a key plug 6 and a key 8.

The outer shell 1 is oblong in cross-section and is provided with a longitudinal central opening 100 accessible from a front end thereof, and a pair of spaced radial through holes 10. The first inner shell 4 is shaped as an annular wall provided with a radial mounting hole 40 and a pair of diametrically opposite radial tumbler holes, 41 and 42 A tumbler pin 44 and a tumbler spring 46 is provided in each tumbler hole, 41 and 42. A wall 47 having a central circular hole 48 is provided on a rear end of the first inner shell 4. The second inner shell 7 is shaped as an annular wall provided with three sets of radial tumbler holes 71 to receive a plurality of tumbler segments 72 and tumbler springs 73. The second inner shell 7 is further provided with radial mounting holes, 74 and 75.

The shackle means 2 is mounted on a rear end of the outer shell 1 and includes a staple 20 and a staple spring 22. The staple 20 has a shorter leg provided with a concave depression 201, and a longer leg provided with an elongated slide notch 203. The control plate 3 is substantially oblong in shape and has a semi-circular central opening 32.

The resisting means 5 includes first and second plug halves, 51 and 52. The first and second plug halves, 51 and 52, are substantially semi-circular in cross-section. Each of the first and second plug halves, 51 and 52, has a clamping face provided with a respective axially extending V-shaped notch, 510 and 520, which cooperatively confine a rectangular receiving space to clamp the shaft portion 530 of a driving shaft 53. The shaft portion 530 of the driving shaft 53 is rectangular in cross-section. The driving shaft 53 further includes a transverse head portion 531 and a tail portion 532 provided on both ends of the shaft portion 530. The tail portion 532 is substantially semi-circular in cross-section. The curved surfaces of the first and second plug halves, 51 and 52, are respectively provided with a pair of axially extending notches, 511 and 521, of varying lengths. The notches, 511 and 521, open from opposite ends of the first and second plug halves, 51 and 52, and have terminating ends spaced from the other end of the first and second plug halves to form a groove-free space between the terminating ends of the notches, 511 and 521. The resisting means 5 is provided in the first inner shell 4 and is spaced from the wall 47 of the latter by means of a cushioning plate 54 and plug springs, 512 and 522.

The key plug 6 is shaped as an annular wall and has a connecting portion 60 on a rear end thereof. The connecting portion 60 includes first and second axially has an annular groove 63 provided adjacent to the connecting portion 60, and three sets of radial tumbler holes 64 to receive a plurality of tumbler segments 65. A detailed description of the key 8 will be found in the succeeding paragraphs.

Figure 2:
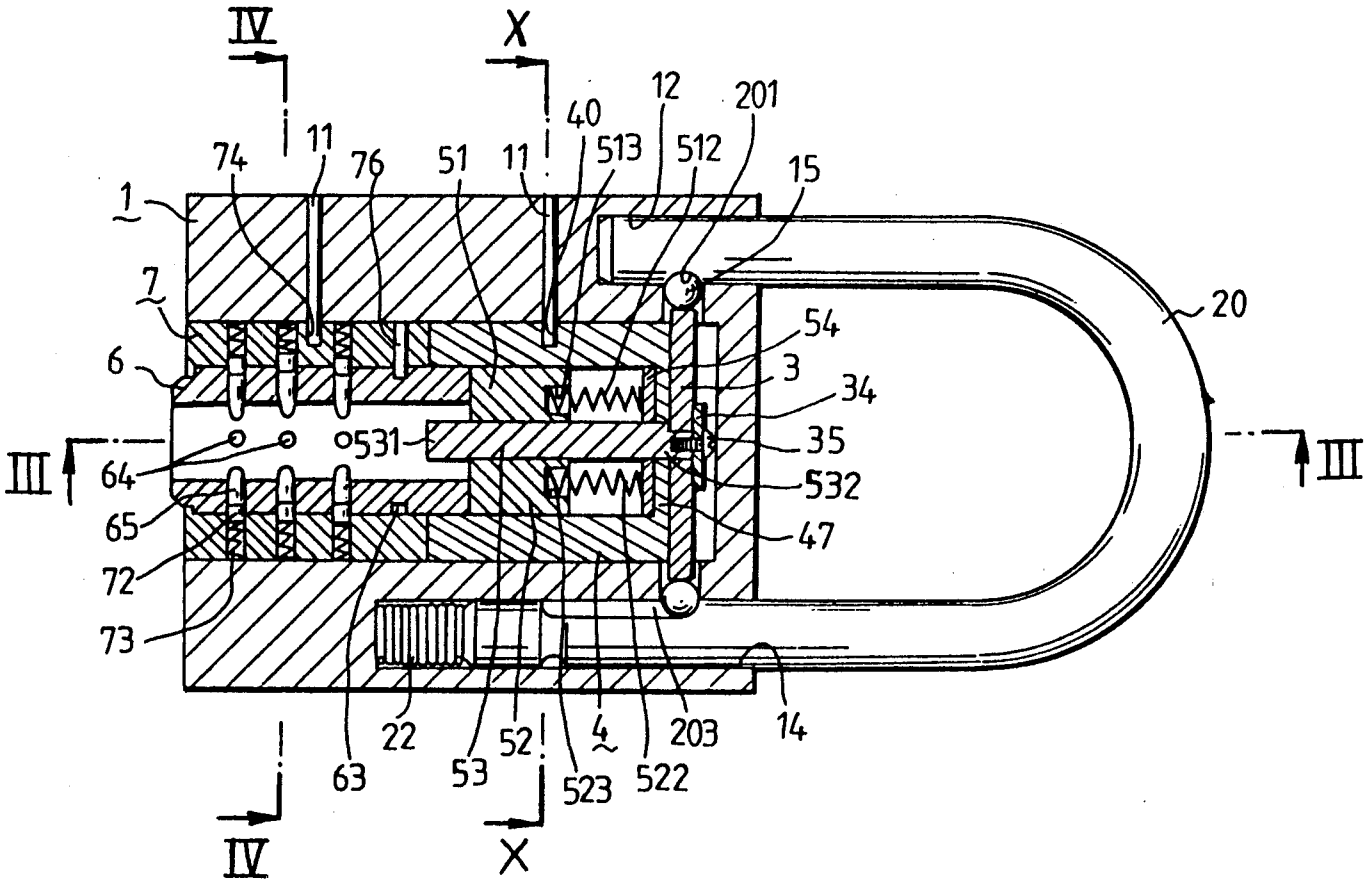
FIG. 2 is a sectional view of the assembled preferred embodiment.
Figure 3:
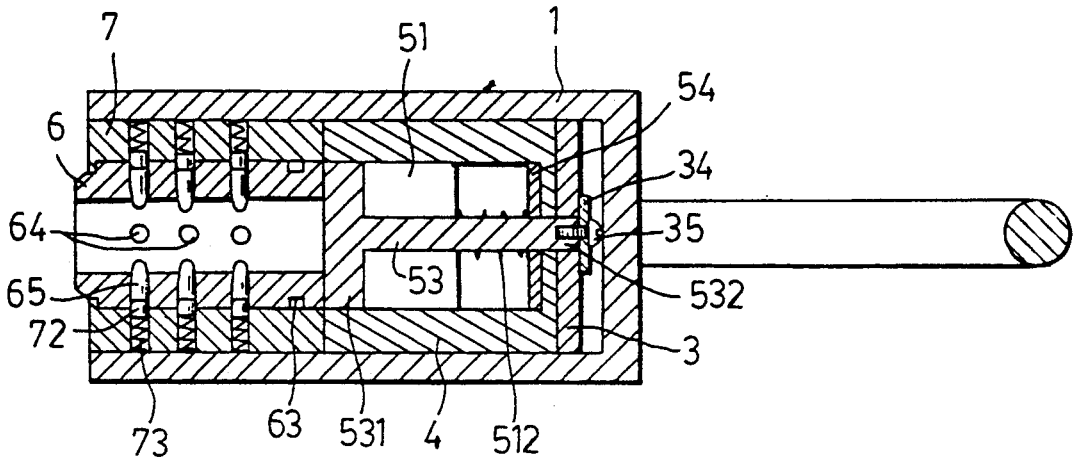
FIG. 3 is a view of the III—III section of FIG. 2.

The assembly and operation of the preferred embodiment is as follows:

Referring to FIGS. 1, 2 and 3, mounting posts 11 extend from the radial through holes 10 and through the radial mounting holes, 40 and 74, so as to secure the first and second inner shells, 4 and 7, to the outer shell 1. The first and second plug halves, 51 and 52, are received in the first inner shell 4 and cooperatively form a cylindrical member in sliding contact with the inner surface of the first inner shell 4. Each of the first and second plug halves, 51 and 52, have spring grooves, 513 and 523 respectively, to receive one end of one of the plug springs, 512 and 522. The cushioning plate 54 abuts against one side of the wall 47 of the first inner shell 4. The other side of the wall 47 is spaced from the rear end of the outer shell 1. The other end of the plug springs, 512 and 522, are in contact with cushioning plate 54. The plug springs, 512 and 522, bias the first and second plug halves, 51 and 52, toward the transverse head portion 531 of the driving shaft 53. The control plate is disposed between the wall 47 and the rear end of the outer shell 1. The tail portion 532 of the driving shaft 53 extends through the circular hole 48 of the wall 47 of the first inner shell 4 and engages the control plate 3 at its central opening 32. A cushioning plate 34 is provided on the other side of the control plate 3. A screw 35 axially engages a threaded bore provided at the distal end of the tail portion 532.

Rotation of the driving shaft 53 correspondingly rotates the control plate 3. The outer shell 1 is provided with a pair of spaced axially extending leg receiving bores, 12 and 14, which are accessible from the rear end of the outer shell 1 and disposed on opposite sides of the longitudinal central opening 100 thereof. The shorter leg of the staple 20 is received in the shorter leg receiving bore 12, while the longer leg of the staple 20 is received in the longer leg receiving bore 14. The staple spring 22 is received in the longer leg receiving bore 14 and is attached to the longer leg of the staple 20 to bias the staple 20 outwardly from the leg receiving bore 14. The longer sides of the control piece 3 respectively urge ball bearings 15 disposed inside the outer shell 1 to engage the concave depression 201 and the slide notch 203, and retain the shorter leg of the staple 20 inside the leg receiving bore 12, thereby placing the preferred embodiment in the locked position, as shown in FIG. 2.

The head portion 531 of the driving shaft 53 is clamped by the first and second arc projections, 61 and 62, of the key plug 6. Rotation of the key plug 6 thus correspondingly rotates the driving shaft 53 to rotate the control plate 3. When the shorter sides of the control plate 3 are aligned with the ball bearings 15, the control plate 3 ceases to urge the ball bearings 15, causing the ball bearings 15 to disengage the concave depression 201 and the slide notch 203. The staple spring 22 expands to release the shorter leg of the staple 20 from the shorter leg receiving bore 12 and places the preferred embodiment in the unlocked position. A connecting post 76 extends from the radial mounting hole 75 of the second inner shell 7 and into the annular groove 63 of the key plug 6 so as to rotatably secure the key plug 6 to the second inner shell 7.

Figure 4:
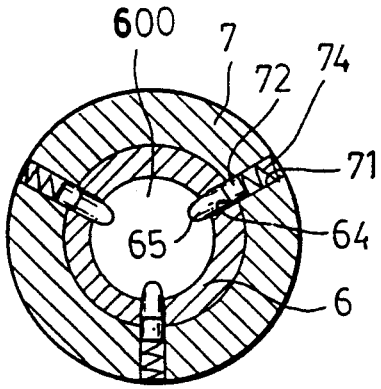
FIG. 4 is a view of the IV—IV section of FIG. 2.

Referring to FIG. 4, the radial tumbler holes, 71 and 64, of the second inner shell 7 and key plug 6 are aligned when the preferred embodiment is in the locked position. The tumbler springs 73 urge the tumbler segments, 72 and 65, toward the center of the key plug 6 so that the tumbler segments 72 are disposed between the junction of the second inner shell 7 and the key plug 6. Rotation of the key plug 6 relative to the second inner shell 7 is thus prevented by the tumbler segments 72. The tips of the tumbler segments 65 extend into an axial key way 600 as defined by the key plug 6.

Figure 5:
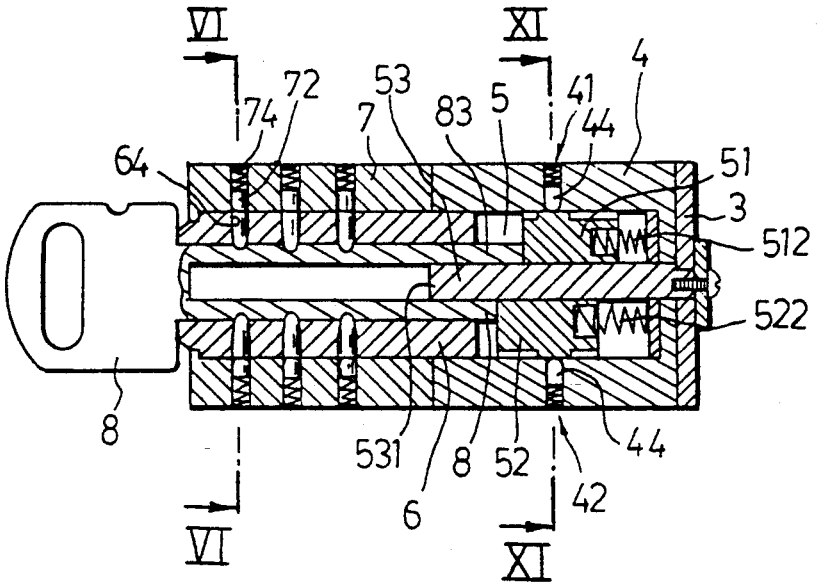
FIG. 5 is a fragmented sectional view of the preferred embodiment when inserted with a correct key.

Referring to FIGS. 5, the key 8 has a substantially cylindrical key body 80 provided with three sets of radial pits 81, and a rear end formed with first and second axially extending curve protrusions, 83 and 84, which define a receiving groove 85 therebetween. A notch 86 is provided near a handle portion of the key 8. This facilitates correct orientation of the key 8 when inserting the same so as to unlock the preferred embodiment.

Figure 6:
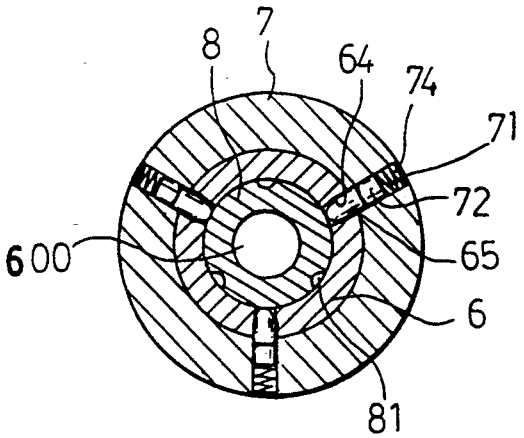
FIG. 6 is a view of the VI—VI section of FIG. 5 illustrating the first lock section of the preferred embodiment.

Referring to FIG. 6, the radial pits 81 are initially not aligned with the radial tumbler holes 64 when the key 8 is inserted into the axial key way 600. The tumbler segments, 65 and 72, compress the tumbler springs 73, and the tumbler segments 65 extend between the junction of the second inner shell 7 and the key plug 6 to prevent rotation of the key plug 6 relative to the second inner shell 7.

Figure 7:
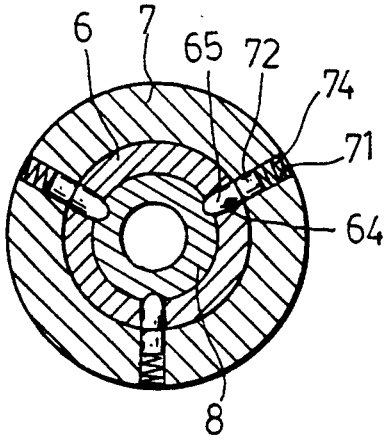
FIG. 7 is a view of the VI—VI section of FIG. 5 illustrating the first lock section after the key is rotated for a predetermined angle.
Figure 8:
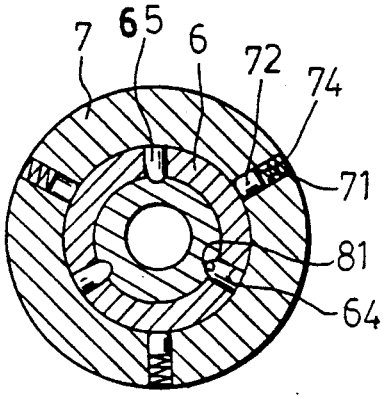
FIG. 8 is a view of the VI—VI section of FIG. 5 illustrating the first lock section after further rotation of the key.

Referring to FIG. 7, after the key 8 has been rotated for a certain angular displacement, the tips of the tumbler segments 65 extend into the radial pits 81 provided on the key body 80. At this stage, assuming that the correct key 8 has been inserted into the preferred embodiment, the junctions of the tumbler segments, 65 and 72, coincide with the junction of the second inner shell 7 and the key plug 6. Referring to FIG. 8, continued rotation of the key 8 causes the tumbler segments, 65 and 72, to separate. The tumbler segments 65 engage the key 8 with the key plug 6, thereby preventing uprooting of the key 8. The key plug 6 thus rotates with the key 8. This illustrates the first locking section of the preferred embodiment.

Figure 9:
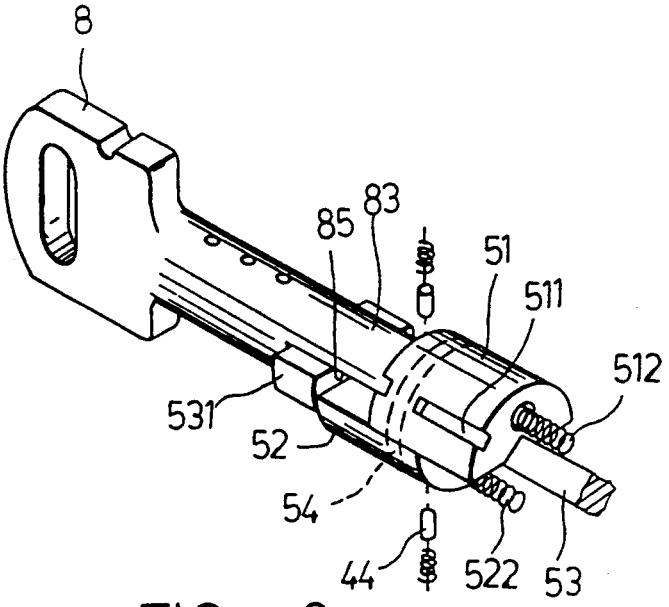
FIG. 9 is a fragmentary perspective view of the preferred embodiment illustrating the second lock section thereof.

Referring to FIGS. 5 and 9, when the key 8 is inserted into the axial key way 600, the first and second curve protrusions, 83 and 84, of the key 8 abut against one end of the first and second plug halves, 51 and 52. The head portion 531 of the driving shaft 53 extends into the receiving groove 85 formed between the first and second curve protrusions, 83 and 84. Rotation of the key 8 correspondingly rotates the driving shaft 53 and the control plate 3, thereby unlocking the preferred embodiment. (The use of the control plate 3 to selectively disengage the shackle means 2 is a technique well known to one skilled in the art and will not be detailed further).

Since the lengths of the first and second curve protrusions, 83 and 84, are different, the degree of compression of the plug springs, 512 and 522, is also different. If the correct key 8 is inserted, a continuous annular path 54 (indicated by phantom lines in FIG. 9) is formed on the curved surface of the first and second plug halves, 51 and 52. The annular path 54 is produced by the alignment of the groove-free space between the notches 511 of the first plug half 51 and the groove-free space between the notches 521 of the second plug half 52. The tumbler pins 44 extending through the radial tumbler holes, 41 and 42, of the first inner shell 4 are on the annular path 54 and do not engage the notches, 511 and 521, thereby permitting rotation of the driving shaft 53 and the first and second plug halves, 51 and 52. This illustrates the second locking section of the preferred embodiment.

The preferred embodiment thus offers two locking sections operable by a single key. If a burglar has successfully conquered the locking protection offered by the tumbler segments, 72 and 65, but has no idea of the exact position of the annular path 54 formed on the first and second plug halves, 51 and 52, the key used by the burglar cannot be uprooted from the preferred embodiment (as shown in FIG. 8). Therefore the burglar is not given a second chance to try a new key to open the lock assembly of the present invention.

Figure 10:
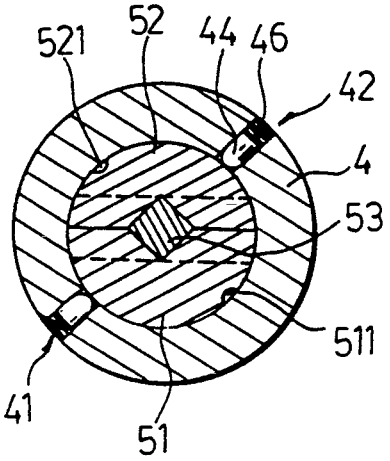
FIG. 10 is a view of the X—X section of FIG. 2 illustrating the second lock section when in an initial position.
Figure 11:
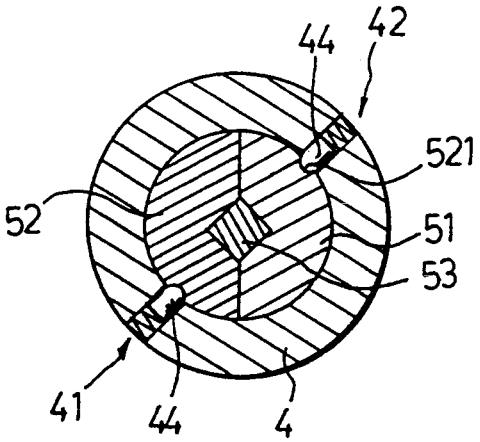
FIG. 11 is a view of the XI—XI section of FIG. 5 illustrating the second lock section after a wrong key was used in an effort to open the preferred embodiment.

Referring to FIG. 10, when no key is inserted into the axial key way 600, the notches, 511 and 521, of the first and second plug halves, 51 and 52, are initially not aligned with the tumbler pins 46. Referring to FIG. 11, when a wrong key is inserted in an effort to open the preferred embodiment, no continuous annular path is formed on the surface of the first and second plug halves, 51 and 52. Thus, when the key is rotated, the driving shaft 53 and the first and second plug halves, 51 and 52, are correspondingly rotated, causing the notches, 511 and 521, to align with the tumbler pins 44. The tumbler springs 46 expand to cause the tumbler pins 44 to engage the first and second plug halves, 51 and 52, at the notches, 511 and 512. The first and second plug halves, 51 and 52, are thus secured to the first inner shell 4, and are prevented from rotating. The wrong key cannot be uprooted since the tumbler segments 65 secure the key to the key plug 6 (as shown in FIG. 8).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A lock assembly, comprising:

a lock shell having a front end, a rear end a longitudinal opening accessible from said front end, and an inner surface provided with a set of first tumbler holes disposed adjacent to said front end and a set of second tumbler holes disposed adjacent to said rear end;

a driving shaft axially disposed in said longitudinal opening and having a transverse head portion, a tail portion journaled on said rear end of the lock shell, and a shaft portion which is rectangular in cross-section;

first and second plug halves received in said longitudinal opening and cooperatively forming a cylindrical member in sliding contact with said inner surface of said lock shell, each of said first and second plug halves having a clamping face provided with an axial first notch, said first notch of said first and second plug halves cooperatively confining a rectangular receiving space, said shaft portion of said driving shaft extending into said rectangular receiving space and being clamped by said first and second plug halves, each of said first and second plug halves having a curved surface formed with at least one axially extending second notch which opens from a first end of said first and second plug halves and having a terminating end spaced: from a second opposite end of said first and second plug halves to provide a groove-free space between said second end of said first and second plug halves and said terminating end of said second notch;

a biasing means to bias each of said first and second plug halves toward said transverse head portion of said driving shaft;

a key plug rotatably mounted to said lock shell inside said longitudinal opening adjacent to said front end, said key plug being formed as an annular wall confining an axial key way and having a set of third tumbler holes aligned with said first tumbler holes when said lock assembly is in a locked position, and a rear end provided with first and second axially extending arc projections to engage said transverse head portion of said driving shaft;

a first set of holding means resiliently extending through said first and third tumbler holes into said key way to engage said lock shell and said key plug when said lock assembly is in said locked position;

a second set of holding means resiliently extending through said second tumbler holes into said longitudinal opening; and a key having a cylindrical key body provided with radial pits, and a front end formed with first and second axially extending curve protrusions which define a receiving groove therebetween, said first and second curve protrusions having different lengths;

said key being inserted in said key way such that said first set of tumbler means engage said radial pits so as to engage said key body with said key plug and disengage said lock shell from said key plug thus permitting rotation of said key plug relative to said lock shell, said curve protrusions moving said first and second plug halves away from said transverse head portion against said biasing means to align said groove-free space of said first and second plug halves and form a continuous annular path, said second set of tumbler means contacting said first and second plug halves at said annular path to permit rotation of said key relative to said lock shell;

whereby, when non-alignment of said groove-free space of said first and second plug halves occurs due to insertion of a wrong key into said key way, rotation of said key plug by the wrong key causing said second set of tumbler means to engage said second notch of said first and second plug halves and prevent further rotation of the wrong key and said key plug relative to said lock shell.

2. The lock assembly as claimed in claim 1, further comprising:

said lock shell having a wall portion extending inwardly into said longitudinal opening of said lock shell and being spaced from said rear end of said lock shell, and a pair of spaced axially extending leg receiving bores provided on said rear end;

a staple member having a shorter leg and a longer leg received in a longer one of said leg receiving bores, and a staple spring received in said longer one of said leg receiving bores, said staple spring being attached to said longer leg of said staple member and biasing said staple member outwardly from said leg receiving bores; and an oblong control plate disposed between said wall portion and said rear end of said lock shell and extending between said leg receiving bores, said tail portion of said driving shaft extending through said wall portion to engage and rotatably drive said control plate, said driving shaft being rotated with said key to correspondingly rotate said control plate between a first position, wherein said control plate engages and retains said shorter leg of said staple member at a shorter one of said leg receiving bores to place said staple member in a locked position, and a second position, wherein said control plate disengages said shorter leg of said staple member to cause expansion of said staple spring and release of said shorter leg from said shorter one of said leg receiving bores to place said staple member in an unlocked position.

* * * * *